US011661296B2

(12) United States Patent
Klipfel et al.

(10) Patent No.: US 11,661,296 B2
(45) Date of Patent: May 30, 2023

(54) METHOD FOR UNWINDING A SHEET OF HOMOGENIZED TOBACCO MATERIAL WOUND ON A BOBBIN WITH SPECIFIC FORCE AND ANGLE RANGES

(71) Applicant: PHILIP MORRIS PRODUCTS S.A., Neuchatel (CH)

(72) Inventors: Yorick Klipfel, St-Saphorin-sur-Morges (CH); Marc Perrinjaquet, Chez-le-Bart (CH)

(73) Assignee: Philip Morris Products S.A., Neuchatel (CH)

( * ) Notice: Subject to any disclaimer, the term of this patent is extended or adjusted under 35 U.S.C. 154(b) by 269 days.

(21) Appl. No.: 16/616,291

(22) PCT Filed: May 30, 2018

(86) PCT No.: PCT/EP2018/064275
§ 371 (c)(1),
(2) Date: Nov. 22, 2019

(87) PCT Pub. No.: WO2018/220063
PCT Pub. Date: Dec. 6, 2018

(65) Prior Publication Data

US 2020/0187549 A1 Jun. 18, 2020

(30) Foreign Application Priority Data

May 30, 2017 (EP) ..... 17173528

(51) Int. Cl.
*B65H 16/10* (2006.01)
*A24B 3/14* (2006.01)
(Continued)

(52) U.S. Cl.
CPC ..... *B65H 16/103* (2013.01); *A24B 3/14* (2013.01); *B65H 23/16* (2013.01); *A24B 15/12* (2013.01);
(Continued)

(58) Field of Classification Search
None
See application file for complete search history.

(56) References Cited

U.S. PATENT DOCUMENTS 672,348 A * 4/1901 Bonsack ..... A24C 5/42 131/72
2,909,222 A * 10/1959 Dreher ..... A24C 1/04 83/510
(Continued)

FOREIGN PATENT DOCUMENTS

DE 3602734 * 8/1987 ..... C07D 295/15
EP 0527427 A2 * 2/1993 ..... B65H 55/043
(Continued)

OTHER PUBLICATIONS

PCT Search Report and Written Opinion for PCT/EP2018/064275 dated Jun. 22, 2018 (15 pages).
(Continued)

*Primary Examiner* — Joseph S Del Sole
*Assistant Examiner* — Guy F Mongelli
(74) *Attorney, Agent, or Firm* — Mueting Raasch Group

(57) ABSTRACT

The invention relates to a method to unwind a sheet of material wound in a bobbin, the method comprising: providing a bobbin of a coiled sheet, the bobbin defining an outer surface and comprising a free portion of the sheet unwound from the bobbin; arranging a compressing element on the outer surface of the bobbin, so as to define a contact line, the contact line being the line separating the free portion of the sheet from the rest of the bobbin; pressing by
(Continued)

means of the compressing element the outer surface of the coiled sheet at the contact line with a force comprised between about (4) Newton and about (16) Newton; and unwinding the sheet from the bobbin pulling the sheet in the unwinding direction.

7 Claims, 4 Drawing Sheets

(51) Int. Cl.
*B65H 23/16* (2006.01)
*A24B 15/12* (2006.01)

(52) U.S. Cl.
CPC ..... *B65H 2301/415185* (2013.01); *B65H 2801/54* (2013.01)

(56) References Cited

U.S. PATENT DOCUMENTS

| | | | | |
|---|---|---|---|---|
| 3,230,958 | A | 1/1966 | Dearsley | |
| 3,423,040 | A | 1/1969 | Humphrey | |
| 5,265,823 | A * | 11/1993 | Doty | B60R 22/44 242/372 |
| 2011/0030709 | A1 * | 2/2011 | Sebastian | A24C 5/34 131/365 |
| 2013/0125322 | A1 * | 5/2013 | Sakashita | A47L 25/005 15/104.002 |

FOREIGN PATENT DOCUMENTS

| | | | | |
|---|---|---|---|---|
| GB | 956961 | * | 1/1964 | |
| GB | 956 961 | | 4/1964 | |
| HU | 222258 B1 | * | 5/2003 | B65H 55/043 |
| RU | 2009/129447 | * | 1/2009 | A24B 3/14 |
| WO | 2017/063958 | | 4/2017 | |
| WO | WO-2017203030 A1 | * | 11/2017 | A47K 10/28 |

OTHER PUBLICATIONS

International Preliminary Report on Patentability for PCT/EP2018/064275 dated Apr. 25, 2019 (14 pages).

* cited by examiner

METHOD FOR UNWINDING A SHEET OF HOMOGENIZED TOBACCO MATERIAL WOUND ON A BOBBIN WITH SPECIFIC FORCE AND ANGLE RANGES

This application is a U.S. National Stage Application of International Application No. PCT/EP2018/064275 filed May 30, 2018, which was published in English on Dec. 6, 2018 as International Publication No. WO 2018/220063 A1. International Application No. PCT/EP2018/064275 claims priority to European Application No. 17173528.5 filed May 30, 2017.

The present invention is related to a method and a kit to unwind a sheet of material wound in a bobbin. In a specific embodiment, the method and the kit are directed to the unwinding of a sheet of homogenized tobacco material wound in a bobbin.

Unwinding bobbins of material can be a difficult task, in particular when the material which is coiled to form a bobbin is at the same time both sticky, so a rather high force need to be applied in order to unwind it, and fragile, so that it can be easily torn apart. Such a material is for example a homogenized tobacco sheet, which can be obtained for example by casting a sheet of homogenized tobacco material. The homogenized tobacco sheet, when coiled in bobbins, is maybe difficult to unwind due to its consistency, sensitivity to heat and low tensile strength, all preventing for instance to simply increase the force applied to the sheet to unwind the bobbin.

In some manufacturing process of homogenized tobacco material, the bobbins are placed in rotating shafts by the operator or by an automatic system. During the start-up of the equipment and once the bobbins are in place in the unwinding system, a certain tension is applied while pulling the homogenized tobacco material sheet. While the equipment speed increases up to the cruise speed, the tension applied to the sheet has to be regulated within a certain range in order to avoid the rupture and total breakage of the homogenized tobacco material sheet. In such manufacturing processes, unwinding speed may have to be lowered in order to prevent as much as possible to tear the homogenized tobacco sheet, which in turn automatically decreases the production speed and hourly production.

In addition to the low tensile strength of the material, some bobbins of homogenized tobacco sheet may have quite variable shapes from one to another, so this shape inhomogeneity has to be taken into account in an apparatus and a method to unwind bobbins of homogenized tobacco sheet.

There is therefore a need of a method and a kit to unwind bobbins of coiled sheet, in particular of sheets of material having low tensile strength or it is "sticky". These method and apparatus are preferably capable to increase the unwinding speed so that the rest of the production line can increase the overall production rate. Further, the method and the kit should preferably minimize ruptures of the sheet while it is unwound from the bobbin.

In a first aspect, the invention relates to a method to unwind a sheet of material wound in a bobbin, the method comprising:

- providing a bobbin of a coiled sheet, the bobbin defining an outer surface and comprising a free portion of the sheet unwound from the bobbin;
- arranging a compressing element on the outer surface of the bobbin, so as to define a contact line, the contact line being a line separating the free portion of the sheet from the rest of the bobbin;

- pressing by means of the compressing element the outer surface of the coiled sheet at the contact line with a force comprised between about 4 Newton and about 16 Newton; and
- unwinding the sheet from the bobbin pulling the sheet in an unwinding direction.

According to a further aspect, the invention relates to a method to unwind a sheet of material wound in a bobbin, the method comprising:

- providing a bobbin of a coiled sheet, the bobbin defining an outer surface and comprising a free portion of the sheet unwound from the bobbin;
- arranging a compressing element on the outer surface of the bobbin, so as to define a contact line, the contact line being a line separating the free portion of the sheet from the rest of the bobbin;
- pressing by means of the compressing element the outer surface of the coiled sheet at the contact line; and
- unwinding the sheet from the bobbin pulling the sheet in an unwinding direction such that an angle between the free portion of the sheet and a radius of the bobbin at the contact line is comprised between about 110 degrees and about 150 degrees or between about 200 degrees and about 300 degrees.

According to invention, it is proposed to arrange a compressing element on the outer surface of a bobbin to be unwound, so as to define the position of a contact line that separates the free portion of the sheet unwound from the bobbin from the rest of the bobbin. When unwinding the bobbin by pulling the free portion of the sheet unwound from the bobbin, the pressure imposed by means of the compressing element imposes a predetermined angle between the free portion of the sheet and the radius of the bobbin at the contact line. It has been found that in this way the mechanical stress imposed on the sheet during unwinding may be stabilized and controlled within an acceptable range, thus avoiding or minimizing the rupture/breakage of the sheet. This is particular advantageous in case of materials, like homogenized tobacco material, that tend to be at the same time both sticky, so a rather high force need to be applied in order to unwind it, and fragile, so that it can be easily torn apart. When unwinding bobbins made of coiled sheet of homogenized tobacco material with the method according to the invention, the reduction or elimination of rupture/breakage of the sheets may possibly increase the unwinding speed and also the overall production rate.

Further, the method of the invention is relatively simple to be applied and does not require expensive or complex machinery.

As used herein, the term "sheet" denotes a laminar element having a width and length substantially greater than the thickness thereof. The width of a sheet is preferably greater than about 10 millimeters, more preferably greater than about 20 millimeters or about 30 millimeters. Even more preferably, the width of the sheet is comprised between about 100 millimeters and 300 millimeters.

An "alkaloids containing material" is a material which contains one or more alkaloids. Among alkaloids, nicotine is a preferred one, which can be found in tobacco.

Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

As used herein, the term "homogenised tobacco material" denotes material formed by agglomerating particulate tobacco, which contains the alkaloid nicotine.

The most commonly used forms of homogenized tobacco material is reconstituted tobacco sheet and cast leaf. The process to form homogenized tobacco material sheets commonly comprises a step in which tobacco dust and a binder, are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making.

The sheet of homogenized tobacco material can be referred to as a reconstituted sheet material and formed using particulate tobacco (for example, reconstituted tobacco) or a tobacco particulate blend, a humectant and an aqueous solvent to form the tobacco composition. This tobacco composition is then casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The sheet of homogenized tobacco material is then rolled in bobbins which needs to be unwound in order to be further processed, to be part for example of an aerosol-forming article, that is to be included in the aerosol-forming substrate of the aerosol-forming article. In a "heat-not-burn" aerosol-generating article, an aerosol-forming substrate is heated to a relatively low temperature, in order to form an aerosol but prevent combustion of the tobacco material. Further, the tobacco present in the homogenized tobacco sheet is typically the only tobacco, or includes the majority of the tobacco, present in the homogenized tobacco material of such a "heat-not-burn" aerosol-generating article. This means that the aerosol composition that is generated by such a "heat-not-burn" aerosol-generating article is substantially only based on the homogenized tobacco material.

As used herein, the term "aerosol forming material" denotes a material that is capable of releasing volatile compounds upon heating to generate an aerosol. Particularly, a sheet alkaloids containing material, more preferably a sheet of homogenized tobacco material, comprising an aerosol former may be classed as an aerosol forming material. An aerosol forming substrate may comprise or consist of an aerosol forming material.

The homogenized tobacco sheet generally includes, in addition to the tobacco, a binder and an aerosol-former, such as guar and glycerine. This composition leads to a sheet which is "sticky", that is, it glues to adjacent objects, and at the same time it is rather fragile having a relatively low tensile strength.

The homogenised tobacco material may have an aerosol-former content of greater than about 5 percent on a dry weight basis. The homogenised tobacco material may alternatively have an aerosol former content of between about 5 percent and about 30 percent by weight on a dry weight basis. Sheets of homogenised tobacco material may be formed by agglomerating particulate tobacco obtained by grinding or otherwise comminuting one or both of tobacco leaf lamina and tobacco leaf stems; alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibres, aerosol-formers, humectants, plasticisers, flavourants, fillers, aqueous and nonaqueous solvents and combinations thereof.

Examples of suitable aerosol formers are glycerine and propylene glycol. The starting point of the invention is a bobbin of a coiled sheet. The sheet could be formed in any material. Preferably, the sheet is a sheet of alkaloids containing material, more preferably of homogenized tobacco material. The bobbin defines an outer surface, which comprises the end of the sheet which is wound in the bobbin. The end of the sheet is loose, that is, it is not blocked to the bobbin by the additional layers of sheet wound on top of it. Therefore, the end of the bobbin can be pulled and the bobbin may unwind. The dividing line between the portion of the last coil of the wound sheet which is still in contact with a layer underneath and the portion of sheet which does not touch any further layer of sheet is the contact line of the bobbin. The remaining portion of the sheet, i.e. the sheet wound in coils which is in contact with an upper or lower layer of sheet, is called globally the rest of the bobbin.

Once a sheet of a material is produced, such as a sheet of homogenized tobacco material, it often needs to be stored at least for a certain time before it is further processed. In order to store it properly, without or with minimal risks of breakage or without occupying too much space, it is commonly wound into bobbins. However, winding sheet of certain materials in a bobbin as such may create several problems in the subsequent unwinding, due to the "sticky" properties of the sheets. Due to the fact that some sheet may be sticky, the layers formed in the bobbin by the sheet wound in itself are prone to glue one onto the others, preventing unwinding.

The present invention is especially adapted to unwind bobbins made of homogenized tobacco material as defined above, however it can be applied as well in any process wherein a sheet having such characteristics need to be unwound from a bobbin.

The bobbin shape can be any. It can have a substantially cylindrical shape, however an oval or anyhow deformed shape, such as a bobbin with bulges deforming a underlying cylindrical shape, do not hinder the application of the teaching of the invention.

In order to properly unwind the bobbin, keeping in mind its stickiness and fragility and thus minimizing breakage but at the same time keeping a relatively high unwinding speed according to the method of the invention, a compressing element is arranged on the outer surface of a bobbin to be unwound, so as to define a contact line that separates the free portion of the sheet unwound from the bobbin from the rest of the bobbin. When unwinding the bobbin by pulling the free portion of the sheet unwound from the bobbin, the pressure imposed by means of the compressing element imposes an angle between the free portion of the sheet and the radius of the bobbin at the contact line. Further, the presence of the compressing element forces the contact line to be at the location of the compressing element. In this way, the mechanical stress imposed on the sheet during unwinding may be stabilized and controlled within an acceptable range, thus avoiding the rupture/breakage of the sheet while keeping a relatively high unwinding speed.

Preferably, in the method of the invention the step of pressing by means of the compressing element includes pressing with a force comprised between about 4 Newton and about 16 Newton the outer surface of the coiled sheet at the contact line. More preferably, the force applied is comprised between about 8 Newton and about 12 Newton and approximately of about 10 Newton. In this range of forces, the sheet of material may not be damaged by the compressing element and at the same a stable contact line is formed. Further, this makes the unwinding process reproducible and "stable" for the bobbins. For all bobbins of a given size and material, wherein the outer surfaces at the same contact line with the same force is compressed, the same unwinding characteristics are to be expected because a control on the stress applied to the sheet is obtained.

Preferably, the method of the invention comprises pulling the free portion of the sheet in an unwinding direction such that an angle between the free portion of the sheet and the radius of the bobbin at the contact line is comprised between about 90 degrees and about 300 degrees. In this way, the angle formed between the radius of the bobbin touching the contact line and the free end of the sheet wound in the bobbin is preferably comprised between about 90 degrees (tangent situation) and about 300 degrees, where the sheet is wound around the compressing element and "returns" toward the bobbin.

More preferably, the angle is comprised between about 110 degrees and about 150 degrees and approximately of about 130 degrees. In this way, the component of the mechanical stress perpendicular to the contact line while unwinding the bobbin is reduced, thus reducing the effect of the stickiness of the sheet on the unwinding.

The free portion of the sheet may also make a "U-turn" around the compressing element. That is, the free portion may contact the majority of the perimeter of the compressing element and then continues to be pulled in a straight line. The angle formed in this case between the radius connecting the contact line and the free portion of the sheet where it is again straight is preferably comprised between about 200 degrees and about 300 degrees (the angle considered is the one between the radius and the end portion facing the bobbin). More preferably, it is comprised between about 250 degrees and about 290 degrees, and approximately about 270 degrees. Angles above 180 degrees indicate situation where the sheet perform a "U turn" around the compressing element.

In case a "U turn" is performed, an expanded contact between a perimeter of the compressing element and the free portion of the sheet is obtained during unwinding of the bobbin compared to the case in which no U-turn is performed. The contact between the sheet and the compressing element takes place for a relatively "long" portion of the sheet. The sheet preferably contacts the compressing element for at least about 60 percent, preferably at least about 40 percent, preferably at least about 20 percent of an outside perimeter of the compressing element. The sheet substantially "wraps around" the compressing element. This allows improving the stabilization and the control of the mechanical stress imposed on the sheet during unwinding within an acceptable range, thus further avoiding or minimizing the rupture/breakage of the sheet.

With radius of the bobbin at the contact line, the radius of the bobbin connecting the center of the bobbin with the contact line is meant.

With angle between the radius of the bobbin at the contact line and the free portion of the sheet, the angle formed between the defined radius and a direction defined by the free portion of the sheet connected to the rest of the bobbin, considering the sheet having a "irrelevant" thickness.

Preferably, the method of the invention comprises moving the position of the compressing element while unwinding the sheet, so that an angle between the free portion of the sheet and the radius of the bobbin at the contact line is comprised between about 90 degrees and about 300 degrees during unwinding. More preferably, the angle is kept between about 110 degrees and about 150 degrees and approximately at about 130 degrees during unwinding. More preferably, the angle is kept between about 200 degrees and about 300 degrees during unwinding.

The advantage above stated is preferably kept during the whole unwinding of the bobbin.

Preferably, the method of the invention comprises:

attaching the compressing element to and end of an arm;

fixing an opposite end of the arm to a pivot point;

rotating the arm around the pivot point while unwinding while keeping the compressing element at the contact line.

Using this set-up, a good control of the force applied on the outer surface of the bobbin is achieved.

Preferably, in the method of the invention the step of pressing by means of a compressing element the outer surface of the bobbin includes varying the position of a mass connected to the compressing element. In order to build a relatively simple mechanism applying a force to the outer surface of the bobbin, advantage has been taken of gravity. The force applied to the bobbin is preferably a result of a combination of forces.

Preferably a force applied by the compressing element is radial, that is, it has a direction along the radius of the bobbin. The radial force can be easily controlled, for example by adjusting the position of the mass.

Preferably, the sheet is a sheet of alkaloids containing material. More preferably, the sheet is a sheet of homogenised tobacco material.

Preferably, the method comprises:

selecting a value of the force pressing the outer surface of the bobbin by means of the compressing element on the basis of one or more characteristic of the bobbin or of the sheet.

The value of the force pressing the sheet may be selected depending on the characteristics of the bobbin itself, for example whether it is cylindrical or it deviates from a cylindrical shape. In the latter case, care may be taken not to tear the sheet when "bumps" are present, and thus a lower force value is considered. Further, the value of the applied force may depend on the material in which the sheet is formed, whether it is more or less sticky or thin, for example.

According to a further aspect, the invention relates to a kit to unwind a sheet of material wound in a bobbin, the kit comprising:

a bobbin defining an outer surface and comprising a free portion of the sheet unwound from the bobbin;

an apparatus including:

a bobbin holder holding the bobbin rotatable around an axis;

a compressing element, said element positioned on the outer surface of the bobbin so as to define a contact line, the contact line being the line separating the free portion of the sheet from the rest of the bobbin;

a pulling device adapted to pull the free portion of the sheet of the bobbin along an unwinding direction;

a presser adapted to push the compressing element against the outer surface of the bobbin with a given force;

a variator associated to the presser apt to vary a value of the given force on the basis of one or more characteristic of the bobbin or of the sheet.

According to a further aspect, the invention relates to a kit to unwind a sheet of material wound in a bobbin, the kit comprising:

a bobbin defining an outer surface and comprising a free portion of the sheet unwound from the bobbin;

an apparatus including:

a bobbin holder holding the bobbin rotatable around an axis;

a compressing element, said element positioned on the outer surface of the bobbin so as to define a contact line, the contact line being the line separating the free portion of the sheet from the rest of the bobbin;

a pulling device adapted to pull the free portion of the sheet of the bobbin along an unwinding direction;

wherein the compressing element and the pulling device are respectively positioned so that an angle between the free portion of the sheet along the unwinding direction and the radius of the bobbin at the contact line is comprised between about 110 degrees and about 150 degrees or between about 200 degrees and about 300 degrees.

The advantages of this kit have been already outlined with reference to the above method according to the invention and are not repeated herewith.

Preferably, in the kit of the invention the compressing element and the pulling device are respectively positioned so that an angle between the free portion of the sheet along the unwinding direction and the radius of the bobbin at the contact line is comprised between about 90 degrees and about 300 degrees, more preferably between about 110 degrees and about 150 degrees and approximately about 130 degrees. Preferably, the angle is preferably comprised between about 200 degrees and about 300 degrees (the angle considered is the one between the radius and the end portion facing the bobbin). More preferably, it is comprised between about 250 degrees and about 290 degrees, and approximately about 270 degrees.

Preferably, the compressing element includes a roller, a static slider or a combination thereof. More preferably, the compressing element includes a plurality of rollers all in contact with the outer surface of the bobbin.

Preferably, in the kit of the invention the compressing element is movable on the outer surface of the bobbin.

Preferably, the apparatus includes a presser adapted to push the compressing element against the outer surface of the bobbin with a given force. More preferably, the force is radial towards the center of the bobbin.

Preferably, the presser includes an arm including a first end attached to the compressing element and a second end fixed to a pivot point, that is adapted to rotate around the pivot point in such a way to position the compressing element at the contact line while unwinding;

a mass that is adapted to move along the arm and to increase or decrease the force that pushes the compressing element against the outer surface of the bobbin;

a locking device that is adapted to lock the position of the compressing element on the outer surface of the bobbin.

Preferably, the presser includes a blocking element adapted to block the mass along the arm. More preferably, the blocking element is a pair of bolts.

Preferably, the locking device includes a toothed element including an end attached to the arm of the presser and a wedge adapted to come into contact with a tooth of the toothed element.

The invention will be further described, by way of example only, with reference to the accompanying drawings in which.

Figure 1:
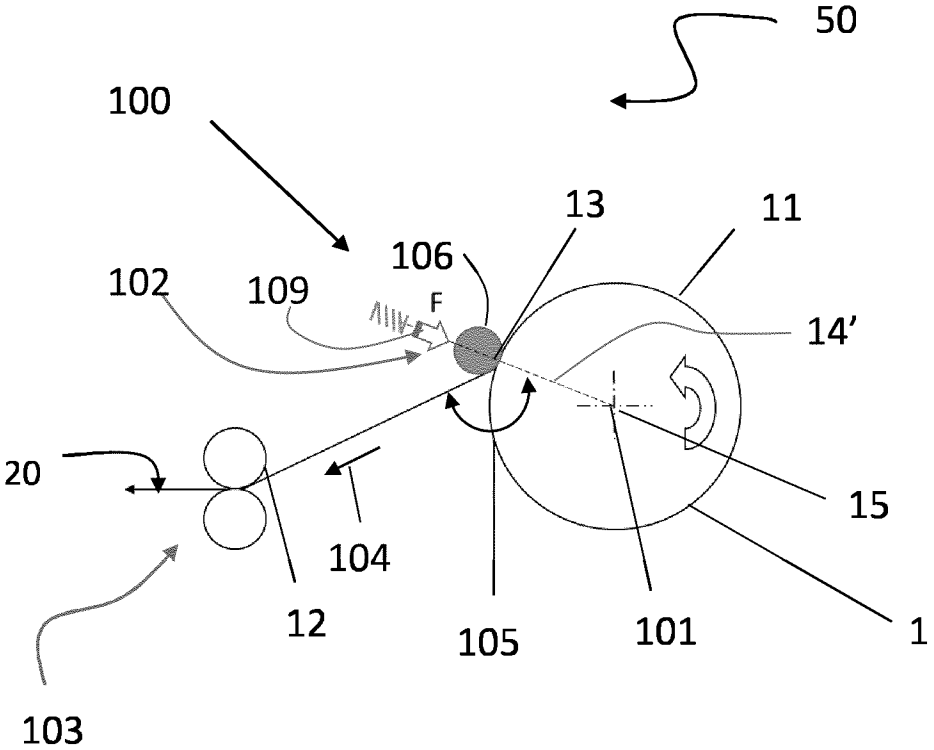
FIG. 1 is a schematic side view of a first embodiment of the apparatus for unwinding a bobbin according to the invention.
Figure 7:
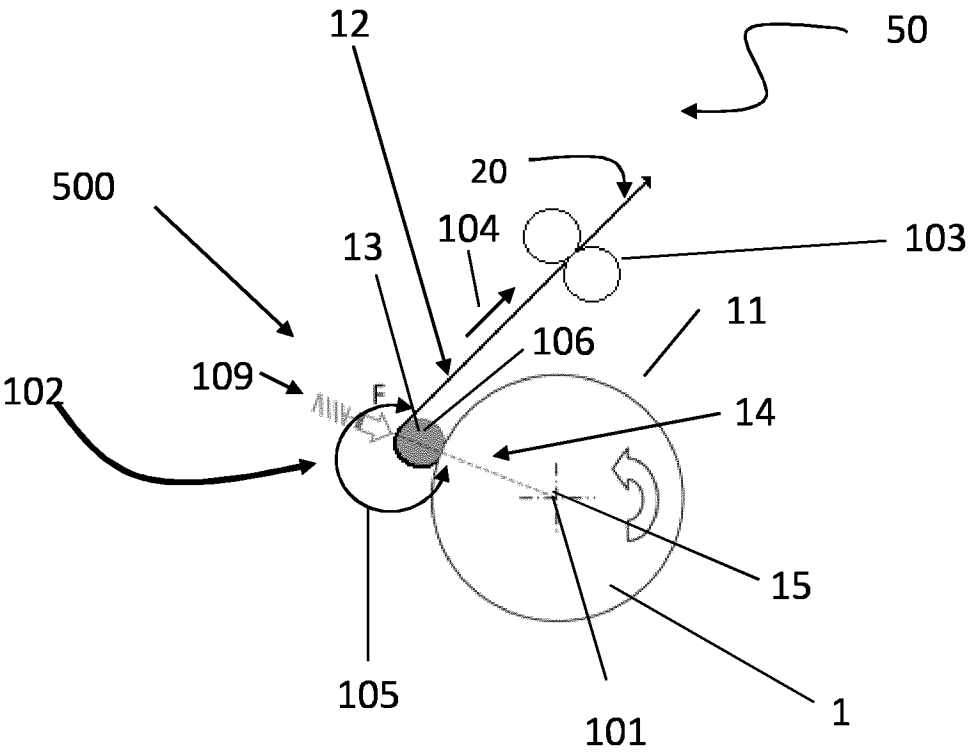

FIG. 7 is a schematic side view of a fifth embodiment of the apparatus for unwinding a bobbin according to the invention In FIG. 1 a schematic side view of apparatus 100 for unwinding a bobbin 1 according to the invention is shown. The apparatus 100 and the bobbin 1 form a kit 50.

Bobbin 1 is formed by winding a sheet 20 of material, which defines a free portion 12 of the sheet unwound from the bobbin 1 and an outer surface 11. Preferably, the sheet 20 of material is a homogenized tobacco sheet.

The separation line between the free portion 12 of the sheet 200 and the remaining of the bobbin is called contact line 13. Further, bobbin 1 defines a center 15 and a radius 14 (represented as a dotted line in the figures). Apparatus 100 includes a bobbin holder 101, a compressing element 102, and a pulling device 103.

Bobbin holder 101 holds bobbin 1. Preferably, a center of the bobbin holder coincides with center 15 of bobbin 1. Preferably, bobbin 1 is inserted in bobbin holder 101. Bobbin holder is rotatable around an axis passing through its center.

Compressing element 102 is adapted to be in contact with the outer surface 11 of the bobbin 1 and to press the same with a given force 109.

The force is preferably directed along the radius 14 of the bobbin, in particular along the radius of the bobbin 14' connecting the center of the bobbin with contact line 13. The force 109 is comprised between about 4 Newton and about 16 Newton and it can be selected and varied depending on the bobbin's and/or sheet's characteristics.

Compressing element may change position during unwinding, that is, the position of the contact line 13 may change during unwinding.

Pulling device 103 comprises a pair of rollers and pulls free portion 12 of bobbin 1 along an unwinding direction 104. The distance between the pulling device 103 and the bobbin 1 depends on the type of bobbin 1, the sheet material, the speed of unwinding and the quantity of sheet material remaining on the bobbin 1. The distance should be as small as possible, preferably less than about 2 meters, preferably less than about 50 centimeters.

The free portion 12 is pulled along the unwinding direction 104 which forms a given angle with radius 14' at the contact line. This angle is called 105 in the following.

In the embodiment depicted in FIG. 1, compressing element 102 comprises a roller 106, which is positioned on outer surface 11 of bobbin 1 and defines the contact line 13, which separate free portion 12 from the rest of the bobbin 1, when the free portion is pulled as detailed below. Compressing element 102 is put into contact with the outer surface 11 of the bobbin 1 and force 109 is applied. During unwinding, the roller 106 rotates as well together with bobbin 1. Preferably, the force 109 is kept within the desired range or substantially at a fixed value.

Figure 2:
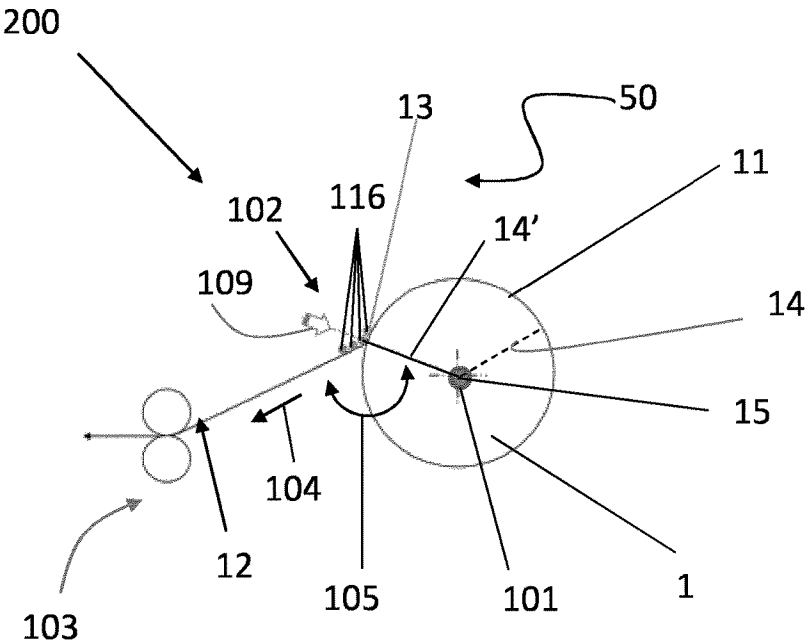
FIG. 2 is a schematic side view of a second embodiment of the apparatus for unwinding a bobbin according to the invention.

In FIG. 2 a schematic side view of a different embodiment of an apparatus 200 for unwinding a bobbin 1 according to the invention is shown.

The difference between apparatus 100 according to the first embodiment above described and the apparatus 200 is in the compressing element. Therefore, the other characteristics of apparatus 200, being the same as or equivalent to those of apparatus 100, are named with the same reference numerals.

Apparatus 200 includes a bobbin holder 101, a compressing element 102 and a pulling device 103.

Compressing element 102 comprises a plurality of rollers 116, which are positioned in contact to outer surface 11 of bobbin 1 and define a contact line 13, which separates free portion 12 from the rest of the bobbin 1.

Preferably, each of the rollers 116 has a diameter smaller than the diameter of roller 106, which was a single roller in the embodiment of FIG. 1. Rollers 116 may be identical to each other or different. Their diameters may vary. Rollers 116 apply a combined force 109 towards the center of the bobbin and along the radius of the bobbin 1.

The functioning of the plurality of rollers 116 and of the apparatus 200 is as described for apparatus 100. The difference is this case that during the pulling of the free portion 12, all rollers 116 rotate (and not only a single roller as in the first embodiment). In apparatus 200 of FIG. 2 angle 105 is approximately of about 130 degrees.

Figure 3:
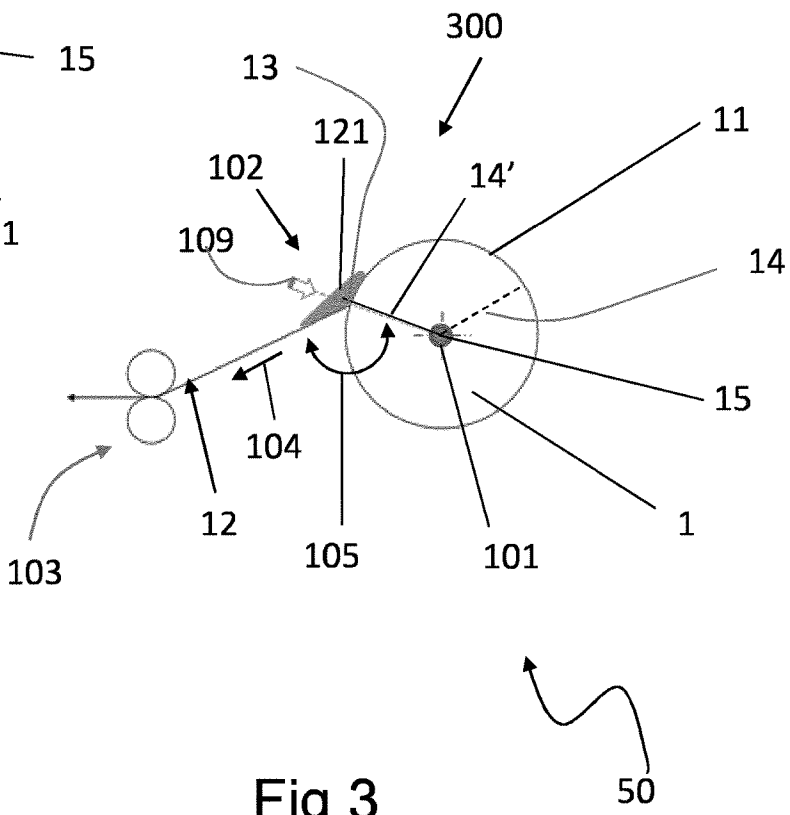
FIG. 3 is a schematic side view of a third embodiment of the apparatus for unwinding a bobbin according to the invention.

In FIG. 3 a schematic side view of a third embodiment of apparatus 300 for unwinding a bobbin 1 according to the invention is shown.

The difference between apparatus 100 and 200 according to the first and second embodiments above described and the apparatus 300 is in the compressing element. Therefore, the other characteristics of apparatus 300, being the same as or equivalent to those of apparatuses 100 and 200, are named with the same reference numerals.

Apparatus 300 includes a bobbin holder 101, a compressing element 102 and a pulling device 103.

Compressing element 102 comprises a static slider 121, which is positioned in contact to outer surface 11 of bobbin 1 and defines a contact line 13, which separate free portion 12 from the rest of the bobbin 1.

The functioning of the static slider 121 and of the apparatus 300 is as described for apparatus 100 or 200. In apparatus 300 of FIG. 4 angle 105 is approximately about 130 degrees.

When the free portion 12 is pulled along direction 104, the bobbin 1 rotates. However, slider 121 does not rotate; it slides on top of the surface of the sheet which unwinds. Force 109 is applied by the slider 121 towards the center 15 of the bobbin along its radius.

Figure 4:
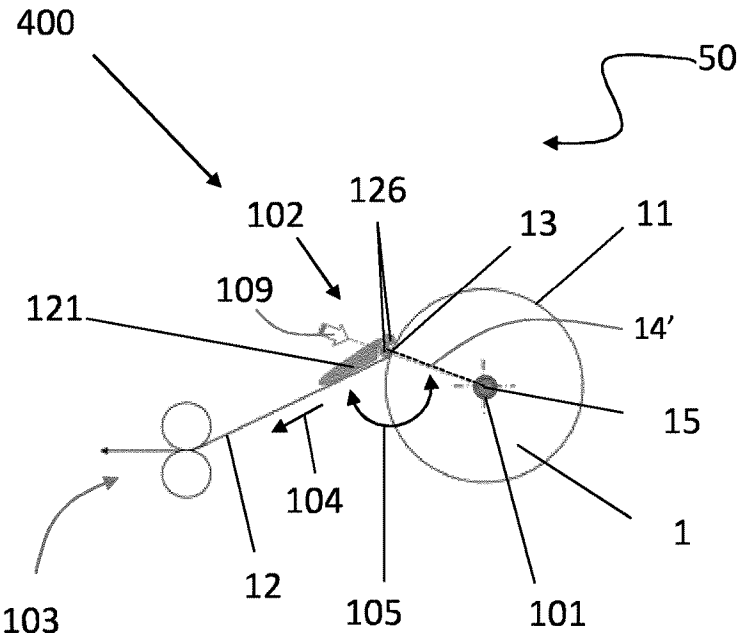
FIG. 4 is a schematic side view of a fourth embodiment of the apparatus for unwinding a bobbin according to the invention.

In FIG. 4 a schematic side view of a fourth embodiment of apparatus 400 for unwinding a bobbin 1 according to the invention is shown.

The difference between apparatus 100, 200 and 300 according to the first, second and third embodiments above described and the apparatus 400 is in the compressing element. Therefore, the other characteristics of apparatus 400, being the same as or equivalent to those of apparatuses 100-300, are named with the same reference numerals. Apparatus 400 includes a bobbin holder 101, a compressing element 102, and a pulling device 103.

Compressing element 102 comprises a combination of a static slider 121 and of a plurality or rollers 126, which are all positioned in contact to outer surface 11 of bobbin 1. Compressing element 102 defines a contact line 13, which separate free portion 12 from the rest of the bobbin 1. The functioning of combination of a static slider 121 and of a plurality or rollers 126 and of the apparatus 400 is as described for apparatus 100. In apparatus 400 of FIG. 4 angle 105 is approximately of about 130 degrees.

When the free portion 12 is pulled along direction 104, the bobbin 1 rotates. Slider 121 does not rotate; it slides on top of the surface of the sheet which unwinds. Rollers 126 rotate around their axis.

In FIG. 7 a schematic side view of a different embodiment of an apparatus 500 for unwinding a bobbin 1 according to the invention is shown.

The difference between apparatus 100, 200, 300 and 400 above described and the apparatus 500 is in the angle 105 which is in the this embodiment of about 270 degrees.

Therefore, the other characteristics of apparatus 500, being the same as or equivalent to those of apparatus 100, are named with the same reference numerals.

Compressing element 102 comprises a roller 106, which is positioned on outer surface 11 of bobbin 1 and defines the contact line 13, which separate free portion 12 from the rest of the bobbin 1

The free portion of the sheet makes approximately a "U-turn" around the compressing element and "returns" toward the bobbin.

Figure 5:
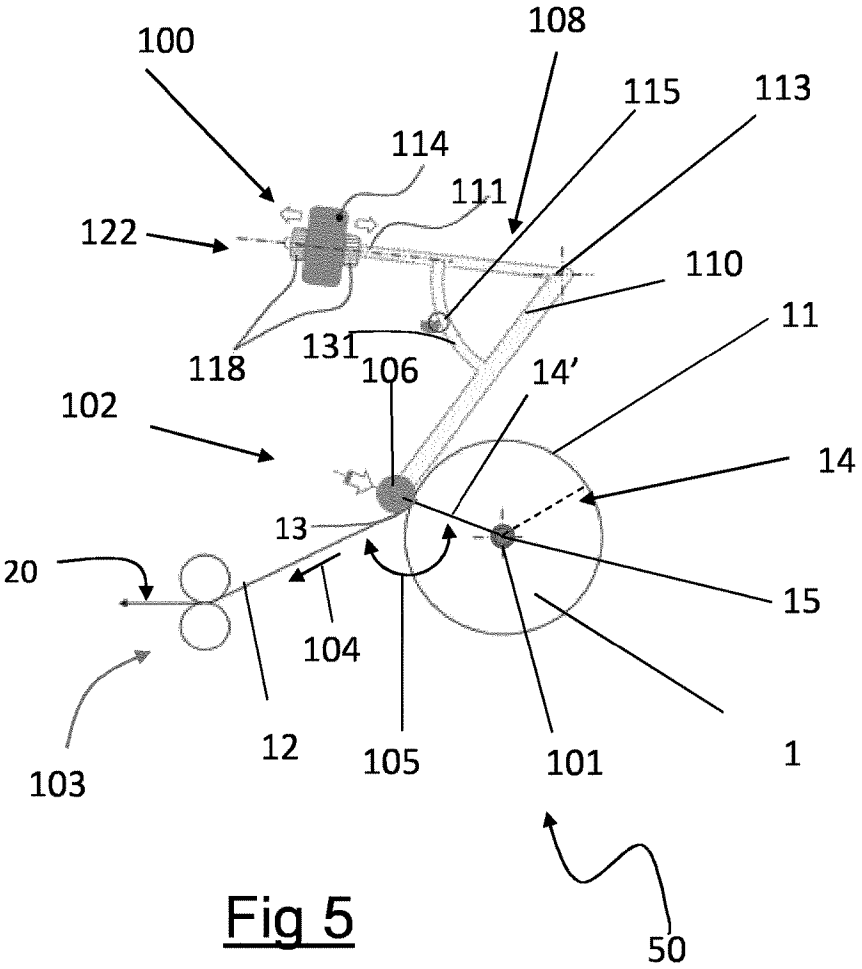
FIG. 5 is a schematic side view of the first embodiment of the apparatus of FIG. 1 in a more detailed manner.

In FIG. 5 a more detailed view of the apparatus 100 according to the first embodiment is shown. In particular, in this figure an example of a device apt to be connected to the compressing element 102 so that the compressing element may exert a force 109 towards the center of the bobbin 1 is given. Although FIG. 5 shows the device applied to the embodiment of FIG. 1 only, the device can be applied to any compressing element of embodiments 1-4 or 7.

The device connected to the compressing element 102 comprises presser 108.

Presser 108 includes a first and a second arm 110, 111, a mass 114, a locking device 115 and a blocking element 118.

First arm 110 has a first end attached to roller 106 and a second end fixed to a pivot point 113.

First arm 110 rotates around pivot point 113 and positions roller 106 at the contact line 13 while bobbin 1 is unwound.

The second arm 111 is connected with an end to the first arm 110 and forms a given angle with the latter 110. First and second arms are fixed together at pivot point 113, so that they rotate together. Preferably the angle formed between the first and the second arms 110, 111 is acute.

In the second arm, the mass 114 is inserted. Mass 114 may move along the second arm for example sliding on the same, within a given interval.

The distance between a free end of the second arm and the mass may therefore vary. The moving mass has thus the function of a variator pf the force 109 applied to the compressing element. Mass 114 moves along arm 110 in the direction indicated by dotted line 122 and may be blocked in a given position by blocking element 118.

In FIG. 5, blocking element 118 includes a pair of bolts.

By varying the position of mass 114 along second arm 111, the force (in the direction indicated by arrow 109) that pushes roller 106 against outer surface 11 of the bobbin 1 increases or decreases.

Therefore the force 109 applied by compressing element 102 (roller 106) onto the outer surface of bobbin 1 depends on the position of the slidable mass 114 on the second arm and it can be changed.

Figure 6:
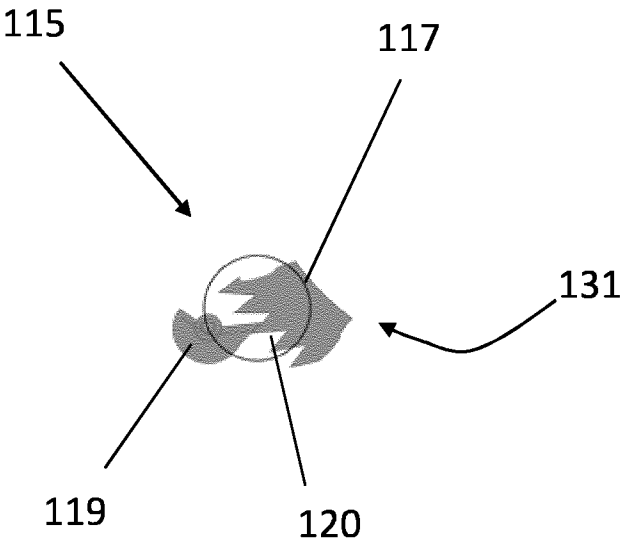
FIG. 6 is a schematic lateral view of a detail of the apparatus of FIG. 5.

Presser 108 also includes locking device 115 which allows rotation of the first and second arms 110, 111 in a single direction (either clockwise or counter clockwise around pivot point 113). Reversal of rotation is not possible due to the locking device. As depicted in FIG. 6, locking device 115 includes a toothed element 117 and a wedge 119 positioned on a bar 131 bridging first and second arm. Toothed element 117 comprises a plurality of teeth 120. Teeth and wedge may interact with each other.

First and second arms 110, 111 are connected by bar 131 in which the locking device is present as in FIG. 5. The wedge 119 is positioned in front of the bar 131 so that it comes into contact with one of the teeth 120 of toothed element 117: wedge 119 may slide on teeth 120 when rotation of arms around pivot point 113 is counter-clockwise, while it locks the position of roller 106 on outer surface 11 of bobbin 1 if the rotation is clockwise. This is possible due to the shape and positioning of wedge 119 and toothed element 117.

Presser 108 therefore allows compressing element 102 to apply a force 109 on the outer surface of bobbin 1 along the radius of the bobbin in a reliable manner, because the force can always be controlled, and even varied, positioning mass 114 as desired.

During functioning, the free portion 12 is pulled along direction 104 by pulling device 103. The angle 105 is formed between the radius of the bobbin 14' at the contact line 13 and the free portion of the sheet. This angle depends on the position of the pulling device, of the compressing element and the bobbin. Locally however, that is, at the contact line 13, this angle is substantially of 90 degrees due to the geometry of the compressing element 102. The intersection of the direction 104 and radius 14' forms an angle 105 which is in the embodiments of FIGS. 1-4 of about 130 degrees, while in embodiment of FIG. 7 of about 270 degrees. This angle varies during unwinding because the size (radius) of the bobbin 1 is reduced. Preferably, this angle remains within prescribed ranges also during unwinding.

The invention claimed is:

1. A method to unwind a sheet of homogenized tobacco material wound in a bobbin, the method comprising:

providing a bobbin of a coiled sheet of homogenized tobacco material, the bobbin defining an outer surface and comprising a free portion of the sheet unwound from the bobbin;

arranging a compressing element on the outer surface of the bobbin, so as to define a contact line, the contact line being a line separating the free portion of the sheet from the rest of the bobbin;

pressing, with the compressing element, the outer surface of the coiled sheet at the contact line with a force comprised between about 8 Newton and about 12 Newton; and unwinding the sheet from the bobbin by pulling the free portion of the sheet in an unwinding direction such that an angle between the free portion of the sheet and a radius of the bobbin at the contact line is comprised between about 110 degrees and about 150 degrees.

2. The method according to claim 1, including:

pulling the free portion of the sheet in an unwinding direction such that an angle between the free portion of the sheet and a radius of the bobbin at the contact line is about 130 degrees.

3. The method according to claim 1, including:

moving the position of the compressing element while unwinding the sheet, so that an angle between the free portion of the sheet and the radius of the bobbin at the contact line is comprised between about 110 degrees and about 150 degrees during unwinding.

4. The method according to claim 1, including:

attaching the compressing element to an end of an arm;

fixing an opposite end of the arm to a pivot point;

rotating the arm around the pivot point while unwinding while keeping the compressing element at the contact line.

5. The method according to claim 1, wherein the outer surface of the bobbin includes varying the position of a mass connected to the compressing element.

6. The method according to claim 1, comprising:

selecting a value of the force pressing the outer surface of the bobbin on the basis of one or more characteristic of the bobbin or of the sheet.

7. The method according to claim 1, wherein the force applied is about 10 Newton.

* * * * *